US007490734B2

(12) United States Patent
Carr

(10) Patent No.: US 7,490,734 B2
(45) Date of Patent: Feb. 17, 2009

(54) COMBINATION TISSUE DISPENSER AND TRASH RECEPTACLE

(76) Inventor: Andrew G. Carr, 17171 Bolsa Chica St. #51, Huntington Beach, CA (US) 92649

( * ) Notice: Subject to any disclaimer, the term of this patent is extended or adjusted under 35 U.S.C. 154(b) by 0 days.

(21) Appl. No.: 11/687,575

(22) Filed: Mar. 16, 2007

(65) Prior Publication Data

US 2008/0223867 A1 Sep. 18, 2008

(51) Int. Cl.
*B65H 1/00* (2006.01)

(52) U.S. Cl. ..... 221/102; 221/34; 221/45; 221/92; 221/152

(58) Field of Classification Search ..... 221/33–36, 221/46, 66, 79, 86, 105, 255, 256, 287, 306, 221/102, 26, 27, 28, 32, 38, 44, 45, 47, 48, 221/49, 50, 62, 63, 64, 65, 92, 97, 101, 210; 232/24; 383/6, 12, 22, 30, 31, 33, 34, 41, 383/43, 61.1, 62, 67, 68, 86, 211
See application file for complete search history.

(56) References Cited

U.S. PATENT DOCUMENTS

| | | | | | |
|---|---|---|---|---|---|
| 2,352,503 | A * | 6/1944 | Walton | 53/173 |
| 3,099,390 | A * | 7/1963 | Dylla | 232/43.2 |
| 3,221,928 | A * | 12/1965 | Horn | 221/34 |
| 4,919,302 | A | 4/1990 | McPherson | |
| 4,948,266 | A * | 8/1990 | Bencic | 383/34 |
| 5,013,099 | A * | 5/1991 | Styles et al. | 312/34.4 |
| 5,054,612 | A | 10/1991 | Meyer, Jr. | |
| 5,145,062 | A | 9/1992 | Crispi | |
| 5,740,923 | A * | 4/1998 | Mayhew | 211/10 |
| 6,076,566 | A * | 6/2000 | Lowe | 141/10 |
| 6,364,156 | B1 * | 4/2002 | Smith et al. | 221/46 |
| 6,371,296 | B1 * | 4/2002 | Rumbough | 206/494 |
| 6,378,721 | B1 * | 4/2002 | Williams | 220/495.08 |
| 6,505,967 | B1 * | 1/2003 | Alfero-Kuronya | 383/11 |
| 6,672,474 | B2 | 1/2004 | May et al. | |
| 6,702,147 | B2 | 3/2004 | Ashford | |
| 6,863,192 | B2 | 3/2005 | Tumlinson | |
| 2002/0175094 | A1 * | 11/2002 | Campbell et al. | 206/233 |
| 2002/0190073 | A1 * | 12/2002 | Hewett | 221/46 |
| 2003/0226851 | A1 * | 12/2003 | Antebi | 221/47 |
| 2004/0045084 | A1 * | 3/2004 | Klosterman | 4/661 |
| 2004/0210997 | A1 * | 10/2004 | Samuels | 4/484 |
| 2006/0000739 | A1 * | 1/2006 | Kadish | 206/494 |
| 2006/0078411 | A1 * | 4/2006 | Casab | 414/408 |
| 2007/0045333 | A1 * | 3/2007 | Mitchell et al. | 221/34 |

* cited by examiner

*Primary Examiner*—Gene Crawford
*Assistant Examiner*—Kelvin L Randall, Jr.
(74) *Attorney, Agent, or Firm*—QuickPatents, Inc.; Kevin Prince

(57) ABSTRACT

A combination tissue dispenser and trash receptacle is disclosed. A substantially hollow housing has a dispensing compartment and a receptacle compartment which each include an aperture therein for ingress or egress of tissues. A dividing wall separates each compartment, and each compartment further includes a retaining flap that covers the aperture for selectively retaining tissues therein. In use, the dispensing compartment is loaded with unused tissues, each being successively removed through the aperture for use when needed. After a tissue is used, the used tissue is inserted past the retaining flap of the receptacle compartment and retained therein. In this way used tissues may be easily discarded after use in a convenient manner. An embodiment having removable receptacle inserts for convenient temporary storage of used tissues is also disclosed.

10 Claims, 3 Drawing Sheets

COMBINATION TISSUE DISPENSER AND TRASH RECEPTACLE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to tissue dispenser, and more particularly to a novel combination tissue dispenser and trash receptacle.

DISCUSSION OF RELATED ART

Disposable tissue boxes are well known, and have become the primary means of packaging facial tissues. Such disposable tissue boxes typically have a flexible retaining flap across an aperture in the box for preventing multiple tissues from being pulled from the box simultaneously. Once a tissue is used, a trash receptacle is needed to discard the used tissue. A trash receptacle is not always conveniently available near such a box of tissue, however.

It has been recognized in the prior art that it is convenient to combine a tissue dispenser with a trash receptacle for the used tissues. For example, U.S. Pat. No. 6,863,192 to Tumlinson on Mar. 8, 2005 teaches such a combination device. However, as this device is a disposable device, designed to be discarded upon the emptying of the unused tissues, no provision is made for allowing convenient emptying of the disposal container thereof. As such, emptying such a device of used tissues is both inconvenient and unsanitary. U.S. Pat. No. 5,145,062 to Crispi on Sep. 8, 1992, has similar drawbacks.

U.S. Pat. No. 6,672,474 to May et al. on Jan. 6, 2004, teaches a non-disposable combination dispenser and trash receptacle. In such a device, the disposal container is emptied periodically. However, the inside of such a container can easily become soiled with material from used tissues, and as such emptying and replacing the tissues in the dispensing container thereof can be unsanitary.

U.S. Pat. No. 6,371,296 to Rumbough on Apr. 16, 2002 teaches a device for holding a pair of disposable tissue boxes, one of which is empty and used as a trash receptacle. The boxes are necessarily the same size since when the dispensing box is empty it is moved over to replace the trash receptacle box. However, due to the volume variance between used and unused tissues, such a device is inefficient since the trash receptacle box always becomes full before the dispensing box is empty, resulting in either waste of unused tissues through premature replacement of the boxes, or inconvenience due to the trash receptacle box being too full for use.

U.S. Pat. No. 6,702,147 to Ashford on Mar. 9, 2004, teaches a device having separate dispensing and disposal containers in a common unit. However, such a device has the drawback that once the disposal container is full it is inconvenient to remove without the dispensing container being removed as well. Moreover, the disposal container is often filled at a different rate than the dispensing container is emptied, due to the volume variance between an unused and a used tissue. Consequently, the disposal container will have to be changed at a different rate than the dispensing container, yet with such a device it is inconvenient to change one without changing the other. Further, such disposal containers cannot fold flat for convenient transport or storage.

Therefore, there is a need for an inexpensive combination tissue dispenser and trash receptacle. Such a needed device would include sanitary inserts that are independently changeable from the dispensing supply of unused tissues. Further, such inserts would be easily transported and stored, and inexpensive to manufacture. Once full, such inserts would be easy to discard and replace. The present invention accomplishes these objectives.

SUMMARY OF THE INVENTION

The present device is a combination tissue dispenser and trash receptacle. A substantially hollow housing has a dispensing compartment and a receptacle compartment which each include an aperture therein for ingress or egress of tissues. In the case of the receptacle compartment, the tissues are generally used and discarded. In the case of the dispensing compartment, the tissues are preferably unused. A dividing wall separates each compartment. Preferably each compartment further includes a retaining flap that covers the aperture for selectively retaining tissues therein. A dispenser aperture opening into the dispensing compartment may be included, such that a disposable box of tissues may be inserted or removed therefrom.

In the preferred embodiment of the invention, the combination includes at least one receptacle insert that comprises a substantially flat collar that has a collar aperture therein. The collar includes an attachment means for attaching to a cooperating insert attachment means of the receptacle compartment, such that the collar aperture is retained on the aperture of the receptacle compartment in substantially overlapping and coaxial alignment. Each insert further includes a flexible bag that is fixed to a back side of the collar and has an open end therein substantially encircling the collar aperture. A retaining flap may be further included to cover the collar aperture for retaining tissues within the flexible bag.

In use, the dispensing compartment is loaded with unused tissues, each being successively removed through the aperture for use when needed. With the preferred embodiment, one insert is inserted into the aperture of the receptacle compartment, the attachment means of the insert engaging the insert attachment means of the housing. After a tissue is used, the used tissue is inserted past the flap of the insert and retained in the flexible bag. Once the flexible bag is full, the insert is removed and replaced with a new insert. In this way used tissues may be easily discarded after use in a convenient manner.

The present invention is an inexpensive combination tissue dispenser and trash receptacle. The present combination device includes sanitary inserts that are independently changeable from the dispensing supply of unused tissues. Further, such inserts are easily transported and stored, and inexpensive to manufacture. Once full, such inserts are easy to discard and replace. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
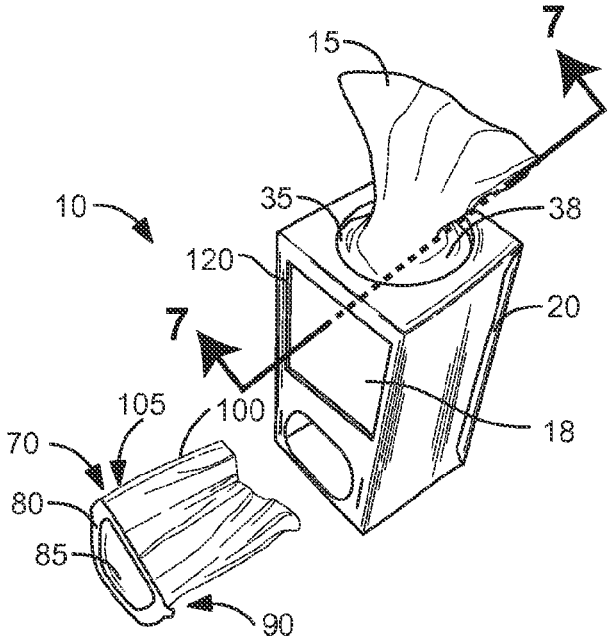
FIG. 1 is a partially exploded perspective view of the invention, illustrating a combination tissue dispenser and trash receptacle and a receptacle insert therefore.
Figure 4:
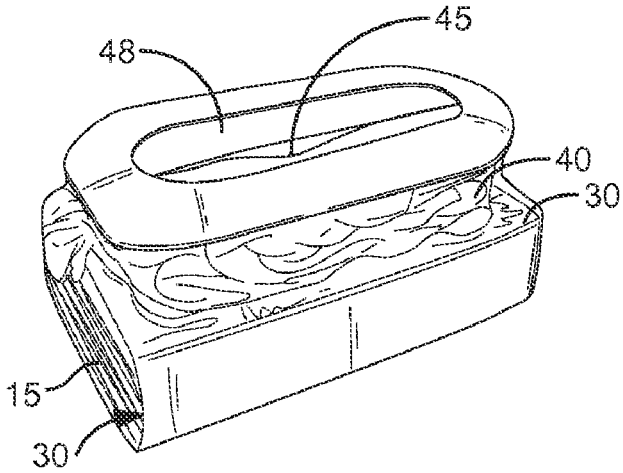
FIG. 4 is a perspective view of an alternate embodiment of the invention, illustrating an empty receptacle compartment of the combination.

FIGS. 1 and 4 illustrate a combination tissue dispenser and trash receptacle. A substantially hollow housing 20 has a dispensing compartment 30 and a receptacle compartment 40. Each compartment 30,40 includes an aperture 35,45, respectively, therein for ingress or egress of tissues 15. In the case of the receptacle compartment 40, the tissues 15 are generally used and discarded. In the case of the dispensing compartment 30, the tissues 15 are preferably unused. A dividing wall 50 separates each compartment 30,40.

Figure 5:
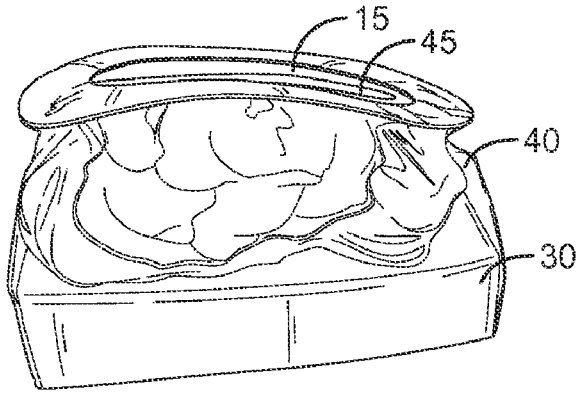
FIG. 5 is a perspective view of the alternate embodiment of the invention, illustrating the receptacle compartment filled with used tissues.
Figure 6:
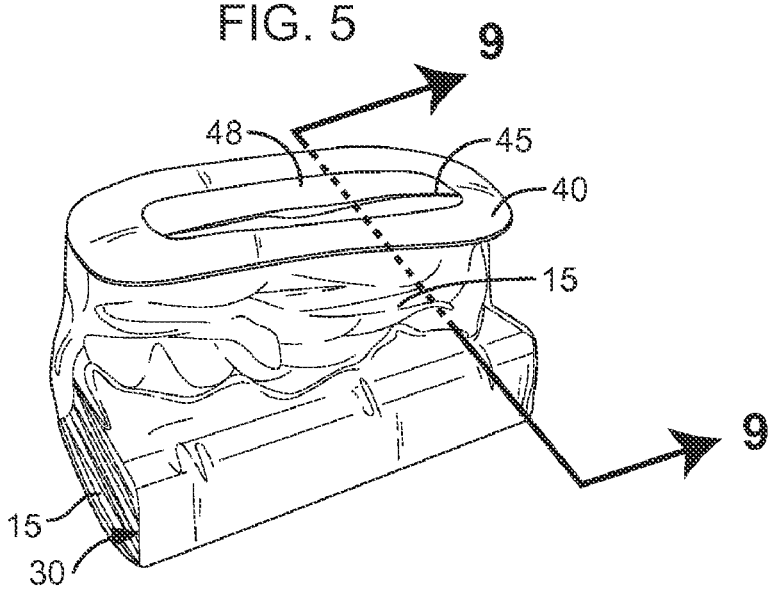
FIG. 6 is a perspective view of the alternate embodiment, illustrating a retaining flap of the receptacle compartment thereof.
Figure 8:
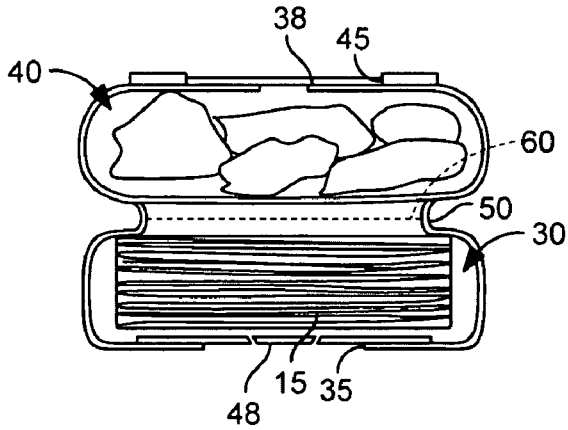
FIG. 8 is a cross-sectional view of the alternate embodiment of the invention, taken generally along lines 9-9 of FIG. 6.

The hollow housing 20 and dividing wall 50 is preferably made from a rigid plastic sheet material, but in an alternate embodiment each may be made from a flexible plastic or paper material for portable, disposable use (FIGS. 4-6). In such an alternate embodiment, the dividing wall 50 may include a perforation 60 for selectively separating the compartments 30,40 from each other (FIG. 8). Preferably each compartment 30,40 further includes a retaining flap 38,48, respectively, that covers the aperture for selectively retaining tissues 15 within the compartment 30,40.

The preferred embodiment of the invention may also include a dispenser aperture 120 opening into the dispensing compartment 30 (FIGS. 1 and 7B), such that a disposable box 18 of tissues 15 may be inserted or removed from the dispensing compartment 30. Preferably the dispenser aperture 120 and the aperture 45 of the receptacle compartment 40 are on a common back side 22 of the housing 20 (FIG. 7B). In such an embodiment, the disposable box 18 of tissues 15 may include the retaining flap 38.

Figure 2:
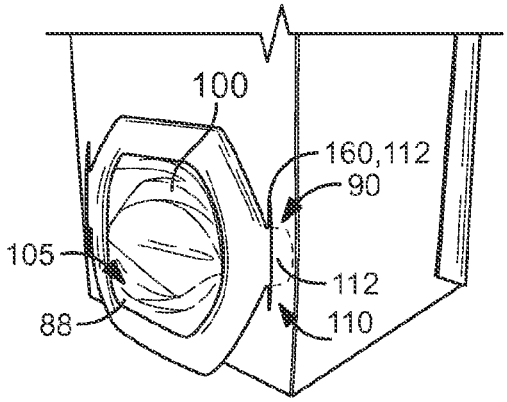
FIG. 2 is a partial perspective view of the receptacle insert as fixed to the combination.
Figure 3:
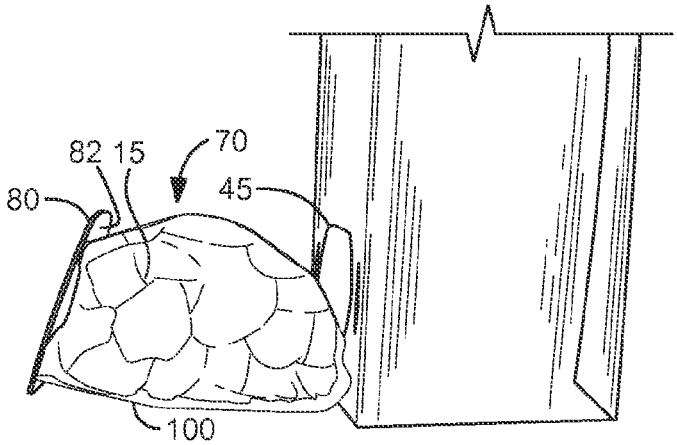
FIG. 3 is a partial side view of the receptacle insert, illustrating the receptacle insert being removed from the combination, the receptacle insert filled with used tissues.
Figure 7A:
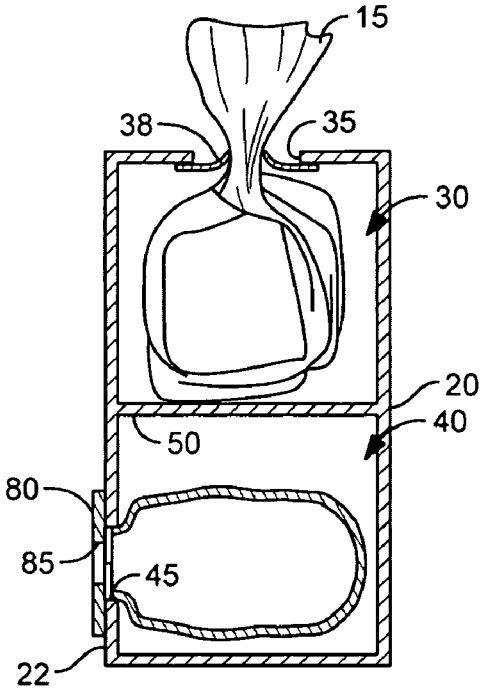
FIG. 7A is a cross-sectional view of the invention, taken generally along lines 7-7 of FIG. 1, illustrating an embodiment without a dispenser aperture for ingress and egress of a disposable box of tissues.
Figure 7B:
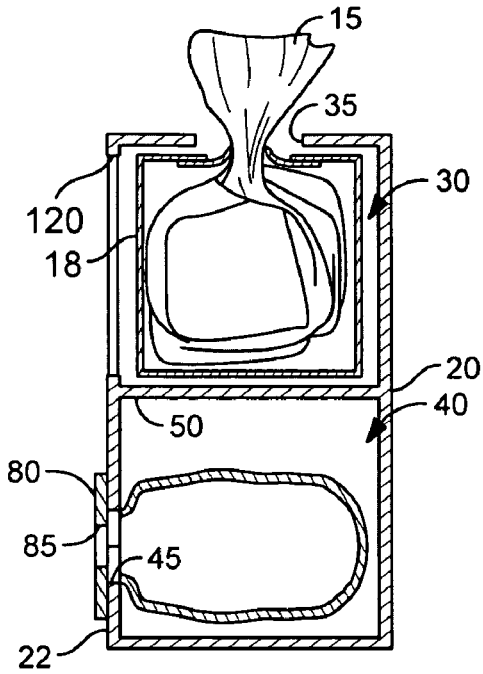
FIG. 7B is a cross-sectional view of the invention, taken generally along lines 7-7 of FIG. 1, illustrating an embodiment having the dispenser aperture for ingress and egress of the disposable box of tissues.
Figure 9:
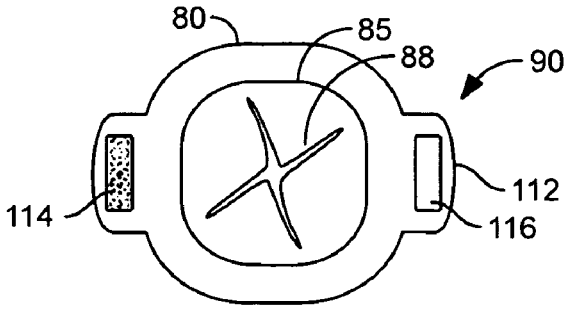
FIG. 9 is a front elevational view of the receptacle insert, illustrating a flat collar and a retaining flap thereof.

In the preferred embodiment of the invention, the combination 10 includes at least one receptacle insert 70 that comprises a substantially flat collar 80 that has a collar aperture 85 therein (FIGS. 3, 7A and 9). The collar 80 includes an attachment means 90 for attaching to a cooperating insert attachment means 110 of the receptacle compartment 40 (FIG. 2), such that the collar aperture 85 is retained on the aperture 45 of the receptacle compartment 40 in substantially overlapping and coaxial alignment. Each insert 70 further includes a flexible bag 100 that is fixed to a back side 82 of the collar 80 and has an open end 105 therein substantially encircling the collar aperture 85. Such a flexible bag 100 is preferably made from either a thin flexible plastic or paper sheet material, and can be folded flat before use for convenient storage and transport. A retaining flap 88 may be further included to cover the collar aperture 85 for retaining tissues 15 within the flexible bag 100.

Preferably the insert attachment means 110 of the housing 20 and the attachment means 90 of each insert 70 is a slot-and-tab means 112, such as illustrated in FIGS. 2 and 9. Alternately, however, the insert attachment means 110 and the attachment means 90 of each insert 70 may each be cooperating portions of a hook-and-loopy type fastener 114, or a temporary adhesive 116. Clearly, other temporary attachment means 90 and insert attachment means 110 may be used as is known in the art.

In use, the dispensing compartment 30 of the preferred embodiment is loaded with unused tissues 15, each being successively removed through the aperture 35 for use when needed. One insert 70 is inserted into the aperture 45 of the receptacle compartment 40, the attachment means 90 of the insert 70 engaging the insert attachment means 110 of the housing 20.

After a tissue 15 is used, the used tissue 15 is inserted past the flap 88 of the insert 70 and retained in the flexible bag 100. Once the flexible bag 100 is full, the insert 70 is removed and replaced with a new insert 70. In this way used tissues 15 may be easily discarded after use in a convenient manner.

With reference to the alternate embodiment of FIGS. 4-6, in use the dispensing compartment 30 is loaded with unused tissues 15, each being successively removed through the aperture 35 for use when needed. After a tissue 15 is used, the used tissue 15 is inserted past the retaining flap 48 of the receptacle compartment 40 and retained therein. Once the receptacle compartment 40 is full, the combination 10 may be either disposed, or the receptacle compartment 40 may be removed from the combination 10 by tearing it away therefrom at the perforation 60.

While a particular form of the invention has been illustrated and described, it will be apparent that various modifications can be made without departing from the spirit and scope of the invention. For example, the exact placement of the sound emitting means 20 may vary within the pocket formed by folding the secondary page 70. The tape 90 may alternately be a dab of glue. Accordingly, it is not intended that the invention be limited, except as by the appended claims.

What is claimed is:

1. A combination tissue dispenser and trash receptacle, comprising:

a substantially hollow housing having a dispensing compartment and a receptacle compartment, each compartment including an aperture therein for ingress or egress of tissues, at least one of the apertures including a retaining flap covering the aperture for temporarily retaining tissues within the compartment, and a dividing wall separating each compartment; and a receptacle insert comprising a substantially flat collar having a collar aperture therein, the collar including an attachment means for attaching to the receptacle compartment with the collar aperture and the aperture of the receptacle compartment substantially overlapping and coaxially aligned, a flexible bag being fixed to a back side of the collar and having an open end therein substantially encircling the collar aperture, a retaining flap covering the collar aperture for retaining tissues within the flexible bag, the housing further including an insert attachment means that cooperating with the attachment means of the collar to retain the collar on the housing.

2. The combination of claim 1 wherein the dividing wall includes a perforated section for selectively separating the compartments from each other.

3. The combination of claim 1 wherein the housing is made from a plastic film material.

4. The combination of claim 1 wherein the housing is made from a pliable paper material.

5. The combination of claim 1 wherein the housing includes a dispenser aperture opening into the dispensing compartment, the dispenser aperture for ingress and egress of a disposable box of tissues.

6. The combination of claim 5 wherein the dispenser aperture and the aperture of the receptacle compartment are formed on a common back side of the housing.

7. The combination of claim 1 wherein the housing is made from a substantially rigid plastic material.

8. The combination of claim 1 wherein the attachment means and the cooperating insert attachment means are a slot-and-tab means.

9. The combination of claim 1 wherein the attachment means and the cooperating insert attachment means are hook-and-loop type fasteners.

10. The combination of claim 1 wherein the cooperating insert attachment means is a temporary adhesive.

* * * * *